United States Patent [19]

Serikow et al.

[11] Patent Number: 5,046,191

[45] Date of Patent: Sep. 10, 1991

[54] PROTECTIVE CLOTHING

[76] Inventors: Victor M. Serikow, 57846 CR 27; Philip C. Barker, 1002 Zollinger Rd., both of Goshen, Ind. 46526

[21] Appl. No.: 568,467

[22] Filed: Aug. 16, 1990

[51] Int. Cl.[5] ..... A41D 13/08

[52] U.S. Cl. ..... 2/2; 2/16

[58] Field of Search ..... 2/16, 59, 161 A, 125, 2/94, 23, 2, 115; 124/44.5, 88, 89

[56] References Cited

U.S. PATENT DOCUMENTS

| | | | |
|---|---|---|---|
| 375,958 | 1/1888 | Skeffington | 2/59 |
| 1,270,697 | 6/1918 | Chapman | 2/16 |
| 2,063,469 | 12/1936 | Smith | 2/94 |
| 2,302,368 | 11/1942 | Evans | 2/94 |
| 2,598,143 | 5/1952 | Smith | 2/94 |
| 3,106,718 | 10/1963 | Raab | 2/125 |
| 3,122,753 | 3/1964 | Smith | 2/125 |
| 3,304,555 | 2/1967 | Anderson et al. | 2/16 |
| 3,637,230 | 1/1972 | Poik | 2/23 |
| 3,703,728 | 11/1972 | Saunders et al. | 2/16 |
| 3,945,042 | 3/1976 | Lobo | 2/2 |
| 3,991,420 | 11/1976 | Savarino | 2/2 |
| 4,048,674 | 9/1977 | Chesnick | 2/16 |
| 4,142,252 | 3/1979 | Storer | 2/16 |
| 4,373,213 | 2/1983 | Erlandson | 2/16 |
| 4,707,861 | 11/1987 | Lavoie et al. | 2/16 |
| 4,787,361 | 11/1988 | Vyprachticky | 124/89 |

FOREIGN PATENT DOCUMENTS

| | | | |
|---|---|---|---|
| 588829 | 6/1977 | Fed. Rep. of Germany | 2/94 |
| 23839 | of 1897 | United Kingdom | 2/94 |

*Primary Examiner*—W. C. Reynolds
*Assistant Examiner*—Amy Brooke Vanatta
*Attorney, Agent, or Firm*—Thomas J. Dodd

[57] ABSTRACT

An article of protective upperwear clothing which includes protective shielding connected to a forearm section of the sleeve. The protective shielding generally includes a patch and concealed elongated strips of protective material which absorb the force of a bowstring after an arrow has been fired.

6 Claims, 2 Drawing Sheets

PROTECTIVE CLOTHING

FIELD OF THE INVENTION

This invention relates to protective clothing and has special application to hunting clothing which has a protective part incorporated directly onto the garment.

BACKGROUND OF THE INVENTION

Protective clothing is an important aspect of many different occupations, sports and activities. Football and hockey players in particular wear clothing with numerous pads sewn into them so as to lessen the chance of injury to various susceptible body parts. A baseball uniform with incorporated padding is shown in U.S. Pat. No. 3,991,420. Other examples of prior protective clothing is shown in the patents of the attached information disclosure statement.

Hunting clothing until now has been designed for comfort and weatherability. Separate padding members are often sold as accessory items to cushion the body against gun recoil and bowstring snap, but these pads are often expensive and can be cumbersome to put on and wear in the field.

SUMMARY OF THE INVENTION

Protective clothing formed according to this invention is designed specifically to protect a bowhunter's forearm from contusions or similar injury caused by bowstring snap after an arrow has been fired. The clothing includes a patch which is sewn or otherwise connected to the forearm area of a hunting shirt, jacket, parka or similar piece of upper body outerwear or underwear. The patch includes one or more rigid or semi-rigid strips incorporated into the patch which absorb the force of impact of the bowstring.

Accordingly, it is an object of this invention to provide for a novel article of protective clothing.

Another object is to provide protective hunting clothing which shields a hunter's forearm against bowstring snap injuries.

Another object is to provide hunting clothing with a sewn-in protective member.

Another object is to provide protective clothing which is easy to manufacture, and economical and comfortable for the hunter to purchase and wear.

Other objects will become apparent upon a reading of the following description.

BRIEF DESCRIPTION OF THE DRAWINGS

A preferred embodiment of the invention has been depicted for illustrative purposes wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use so others skilled in the art might follow its teachings.

Figure 1:
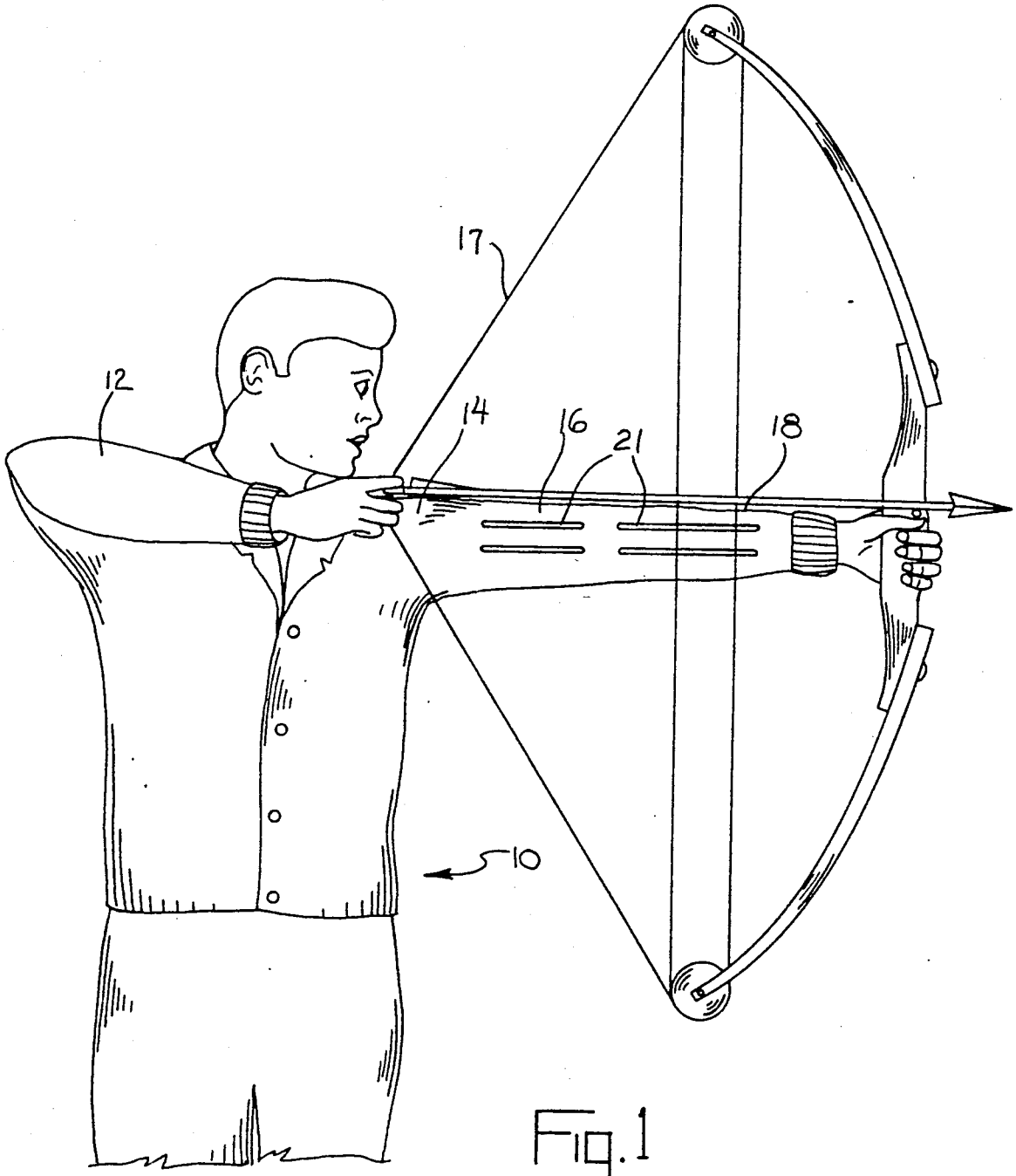
FIG. 1 is a perspective view of a piece of upper outerwear incorporating &he protective member of this invention.

Referring to FIG. 1, reference numeral 10 generally designates an article of hunting clothing, shown in the drawing as a hunting shirt. Clothing article 10 may also be other type of upper body outerwear, such as a jacket, parka, long sleeve underwear or similar article, and includes sleeves 12, 14 as shown which cover the wearer's arms. Clothing article 20 may be of any suitable fabric and pattern currently available on the market to hunters and other outdoor sportsmen.

Article 10 includes a patch 16 formed of suitable fabric or other material which is connected to one of sleeves 12, 14 at the forearm portion 18 thereof. Patch 16 may be connected as by stitching 20 to either right sleeve 12 or left sleeve 14 dependant upon whether article is to be worn by a left-handed or right-handed shooter respectively. Patch 16 is normally connected to sleeve 14 (or 12) so that when article 10 is worn, the patch covers that portion of the wearer's forearm which is exposed to the slap of a bowstring 17 immediately following the shooting of an arrow.

Figure 2:
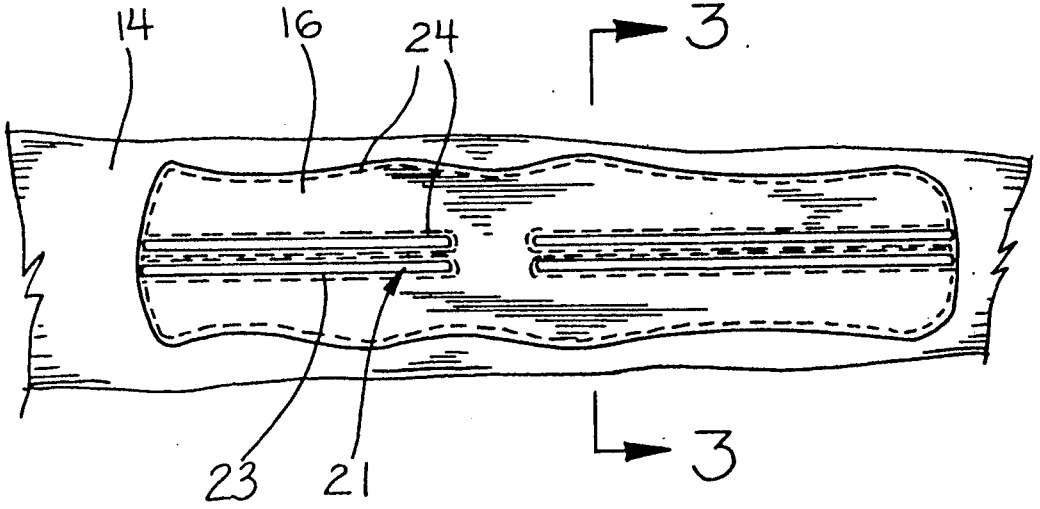
FIG. 2 is a fragmented plan view of the sleeve showing the protective member.
Figure 3:
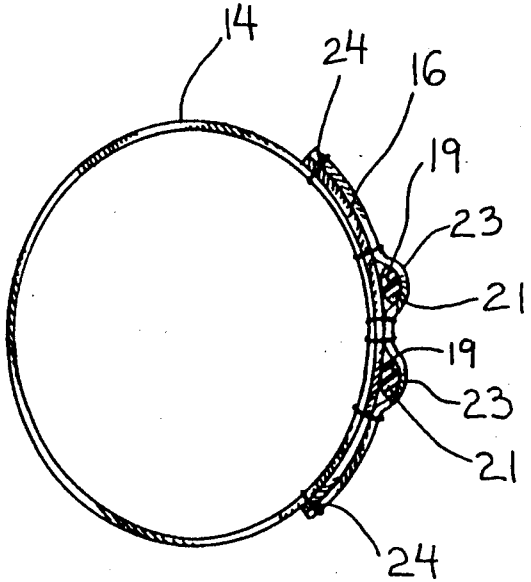
FIG. 3 is a sectional view taken along line 8—8 of FIG. 2.

As shown in FIGS. 2–4, patch 16 includes one or more internal pockets 19 (four are shown) each of which house protective strips 21. Strips 21 are formed of suitable rigid or semi-rigid material such as metal or hard plastic and are enclosed by a fabric covering 28 connected to patch 16 as by stitching 24. Strips 21 and pockets 19 are usually oriented transverse to the normal path of bowstring 17 and longitudinally down the length of sleeve 12 or 14 to provide maximum protection against bowstring snap. The exact shape and arrangement of patch 16 and strips 21 will be the choice of the garment manufacturer as it sees fit to provide degrees of protrusion against bowstring snap injuries.

It is understood that the above description does not limit the invention to the above-given details, but may be modified within the scope of the following claims.

We claim:

1. Protective upperware clothing for bowhunters and bow sportsmen, said protective comprising a portion for covering a torso area, and integral sleeves to accommodate the arms of a wearer, each sleeve having a forearm portion for covering a forearm, a protective member permanently connected directly to one of said sleeve forearm portions adjacent an inner portion of a user's forearm exposed to bowstrip slap, said protective member including an elongated strip of semi-rigid material connected to said protective member to cushion the forearm against bowstring slap.

2. The clothing of claim 1 wherein said elongated strip is oriented longitudinally down a length of said sleeve.

3. The clothing of claim 1 wherein said protective member includes a fabric patch sewn directly to said sleeve.

4. The clothing of claim 3 wherein said protective member includes an enclosed pocket, said pocket containing said elongated strip, said pocket connected directly to said strip whereby the strip is concealed.

5. The clothing of claim 4 and a second pocket oriented substantially parallel to said first-mentioned pocket, a second elongated strip of protective material housed in said second pocket.

6. The clothing of claim 4 wherein said elongated strip is formed of metal or hard plastic.

* * * * *